US007841153B1

(12) United States Patent
Braithwaite

(10) Patent No.: US 7,841,153 B1
(45) Date of Patent: Nov. 30, 2010

(54) UNIQUE LANAI

(76) Inventor: Mary M. Braithwaite, 3944 Holin La., North Port, FL (US) 33730

( * ) Notice: Subject to any disclaimer, the term of this patent is extended or adjusted under 35 U.S.C. 154(b) by 372 days.

(21) Appl. No.: 12/148,750

(22) Filed: Apr. 23, 2008

Related U.S. Application Data

(63) Continuation-in-part of application No. 10/704,405, filed on Nov. 10, 2003, now abandoned.

(51) Int. Cl.
*E04C 3/00* (2006.01)

(52) U.S. Cl. ..... 52/834; 52/211

(58) Field of Classification Search ..... 52/377.3, 52/312, 244, 716.1, 716.4, 716.8, 717.05, 52/211
See application file for complete search history.

(56) References Cited

U.S. PATENT DOCUMENTS 3,421,269 A * 1/1969 Medow ..... 52/86
5,433,048 A * 7/1995 Strasser ..... 52/288.1
5,505,245 A * 4/1996 Badalamenti ..... 160/38
6,421,964 B1 * 7/2002 Schiedegger et al. ..... 52/94
6,481,170 B1 * 11/2002 Savenok et al. ..... 52/288.1
2004/0045239 A1 * 3/2004 Milu ..... 52/311.1

* cited by examiner

*Primary Examiner*—Richard E Chilcot, Jr.
*Assistant Examiner*—Jessica Laux
(74) *Attorney, Agent, or Firm*—Frank A. Lukasik

(57) ABSTRACT

A combination of an enclosure and a treated foam design and a method of manufacturing a treated foam design and combining the foam design with an enclosure consisting of a pool cage having vertical and horizontal aluminum tubing sections. After the enclosure (cage) is measured, the measurements are entered into an auto cad program and the cad file is entered into a computer controlled contour cutter. The colonnade pieces are then painted. The columns, cornices and trim contain depressions to fit around and conceal the tubing sections or tent poles. The aesthetically formed foam columns, cornices and trim are attached to the enclosure structure with a construction adhesive.

2 Claims, 7 Drawing Sheets

UNIQUE LANAI

RELATED INVENTION

The instant invention is a Continuation-In-Part of U.S. patent application Ser. No. 10/704,405, Filed Nov. 10, 2003, abandoned.

1. FIELD OF THE INVENTION

The present invention relates generally to building structures and more particularly to shaped and treated foam designs, attached to screened enclosures and a method for the beautification of screened enclosures by use of shaped and treated foam designs, such as polystyrene, attached by adhesive magnets, adhesives, and/or hardware to aluminum pool cages or lanais.

2. RELATED ART

All pool enclosures heretofore known are utilitarian structures lacking aesthetic appeal. The art has long provided pool enclosures where fastening screws, screen-retailing rubber splines, and the like are exposed to view. These structures are often attached to beautiful homes and serve to cheapen the home. Attractive or pleasing-to-the-eye pool enclosures having aesthetic means for covering utilitarian bolts and the like are not found in the prior art.

There are a number of prior art products that are related to the subject invention as exemplified by the following patents.

U.S. Pat. No. 5,193,322 discloses an elongated base molding, a trim recess, a trim molding fitted within the trim recess and retention inserts in the base molding for holding the trim molding in place.

U.S. Pat. No. 5,444,956 discloses trim molding in which a base molding member is provided with tracks for retaining movable inserts with a first insert and a second insert providing a background visible through the cut portions of the first insert, thereby enabling a plurality of different cut portions and background combinations to be obtained.

U.S. Pat. No. 6,138,417 discloses a roof structure covered by a plurality of easily removable panels of screen or translucent or tinted glass or plastic covering material for ease of installation and removal of panels in case of unusually high snow fall or high winds.

U.S. Pat. No. 6,192,643 discloses a pool enclosure system which includes a plurality of extension members for providing posts and beams the collectively form a pool enclosure when assembled; each of the extrusion members has at least a first wall with an attachment means formed thereon along a predetermined extent thereof.

U.S. Pat. No. 6,206,965 to Rao et al. discloses apparatus for coating a decorative workpiece.

U.S. Pat. No. 6,446,399 to Lecours discloses a pre-fabricated curved-profile architectural element and method for pre-fabricating the item.

U.S. Patent Application Publication No. 20040045239 to Milu discloses architectural building products and methods for their manufacture.

None of the above mentioned references disclose nor suggest the pool enclosure/tent having a plurality of tubing sections/tent poles making up the walls and roof section of the enclosure as disclosed and claimed by the instant invention There is a clear need in the pool enclosure industry for a system that provides a pool enclosure having the appearance of a work of art rather than just a utilitarian structure. The needed pool enclosure additions would enhance the appearance of the finest homes and add significant value thereto, rather than detract therefrom as is the case with the system known prior to this disclosure. Furthermore, the strength of the attached foam provides additional support and rigidity to protect the pool cage from strong winds.

However, at the time the present invention was made, the need for aesthetics was not apparent to the pool enclosure industry nor was there anything in the art that would have suggested to workers of ordinary skill in the art how a beautiful pool enclosure could be built.

SUMMARY OF THE INVENTION

It is believed apparent from a consideration of these references that none of them, taken either singly or in combination, disclose or suggest the features of the present invention.

A primary feature of the present invention is the beautification of screened enclosures and tents by use of shaped and treated foam designs, attached to the enclosures and tents by adhesives and adhesive magnets and or hardware to aluminum cages or lanais.

A plurality of aesthetic foam columns and foam trim are placed over the framework of the pool cage on the inside and/or outside of the cage. The foam may have many architectural columns and the trim (contoured shapes) may be placed either around the column and the column is set inside the contoured trim or it is made solid and the column is placed on top of the contoured trim. In addition, the type of architectural columns may be used to beautify large tents of the type used at large gatherings or events. The decorative trim of the invention is preferably made from polystyrene, such as "Styrofoam™", and is attached to the pool cage structure by either adhesives, magnets or VELCRO™ (hook and loop). Hardware may also be used. The easily removable foam trim of the invention is especially important when the cage screen must be replaced.

The instant invention is manufactured using a unique process and system for marketing, designing and a unique method for manufacturing the foam columns and foam trim. After measuring the screen enclosure or Lanai, the measurements are entered into a program called AUTO CAD LT. After the auto Cad design is complete, the auto Cad is entered into Adobe Photo Shop to be rendered for the client's approval. The Cad file is entered into a machine called a Computer Controlled Contour Cutter (CCCC).

In a preferred embodiment, a two pound foam is used to provide a superior product for the colonnades. Shapes to create the colonnade are cut by the contour cutter and then custom fit to the enclosure. Once the pieces are custom fit, they are returned to the manufacturer for coating. Colonnade pieces are then painted and then attached to the existing screen enclosure or lanai with a construction adhesive.

DETAILED DESCRIPTION OF THE INVENTION

Figure 1A:
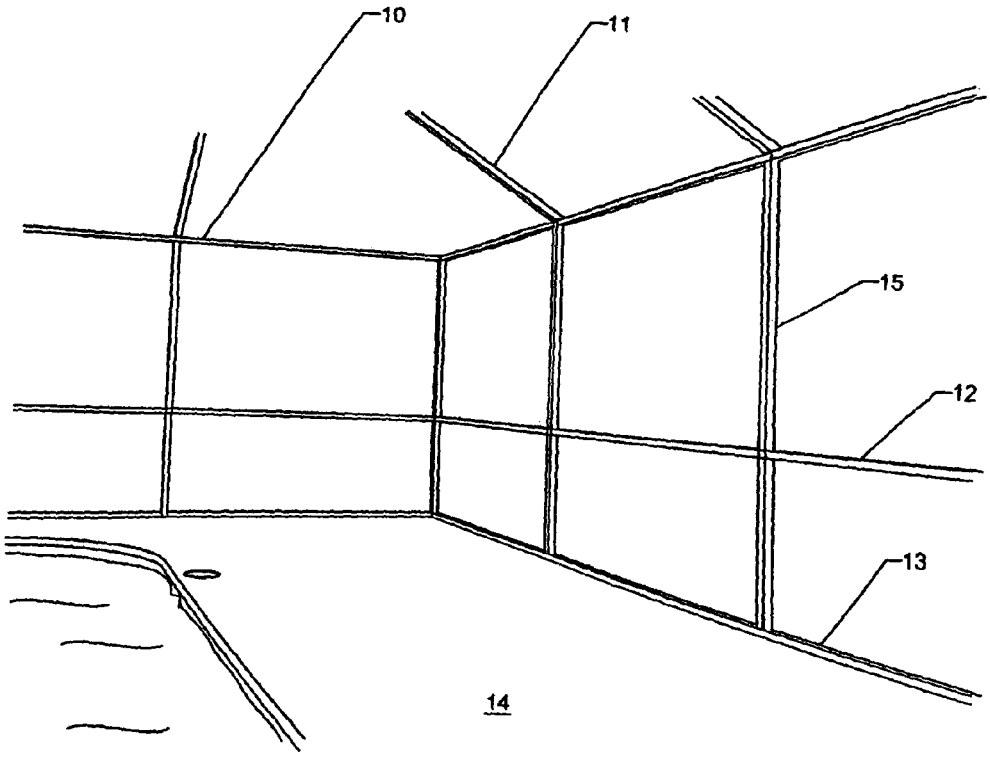
FIG. 1A Prior Art
FIG. 1*a* (PRIOR ART), a perspective view of a prior art pool cage.
Figure 1B:
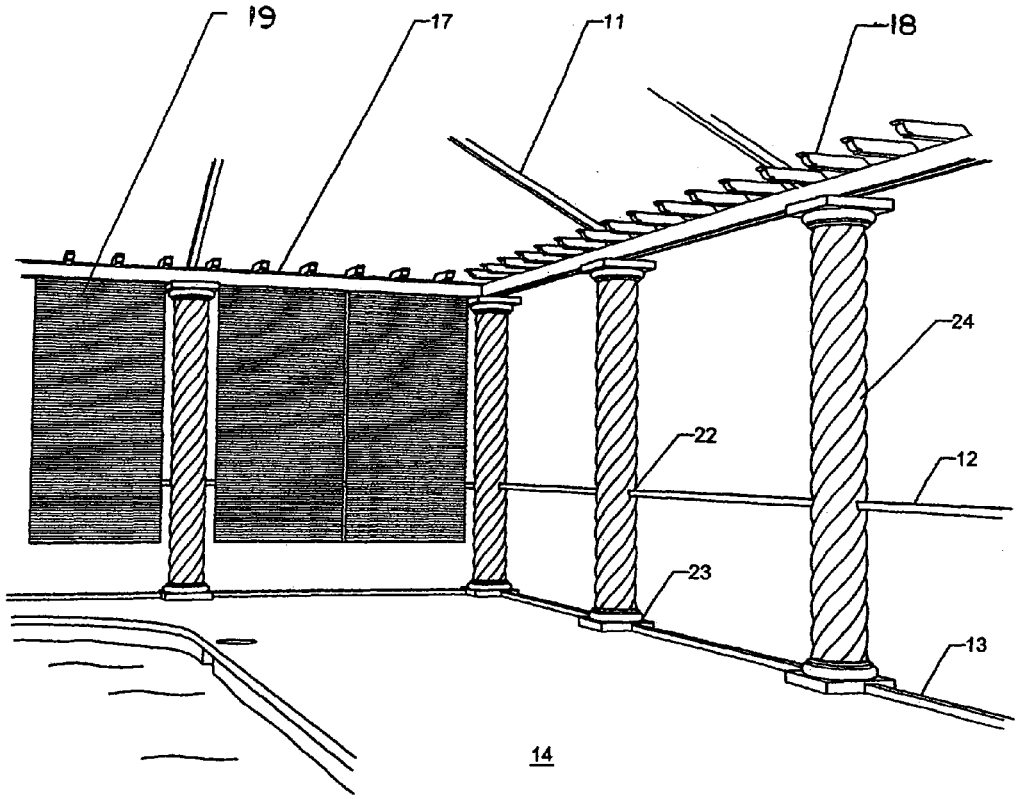
FIG. 1*b*, is a perspective view of a pool cage showing the shaped and treated foam designs of the invention attached to a pool cage.

FIG. 1*a*, the PRIOR ART drawing shows the basic structure of a typical pool enclosure 14 (pool cage) before the improvements of the invention are added. The frame of the pool cage 14 is composed of a plurality of vertical sections of rectangular aluminum tubing 15, a plurality of sections of horizontal aluminum tubing 12 attached between and connecting the vertical tubing sections 15, the base tubing 13, the top cap tubing 10 and the roof tubing 11. The exterior of the aluminum tubing used in the pool cage 14 contains screen engaging means (not shown) which are easily removable when the screening must be replaced.

Figure 2:
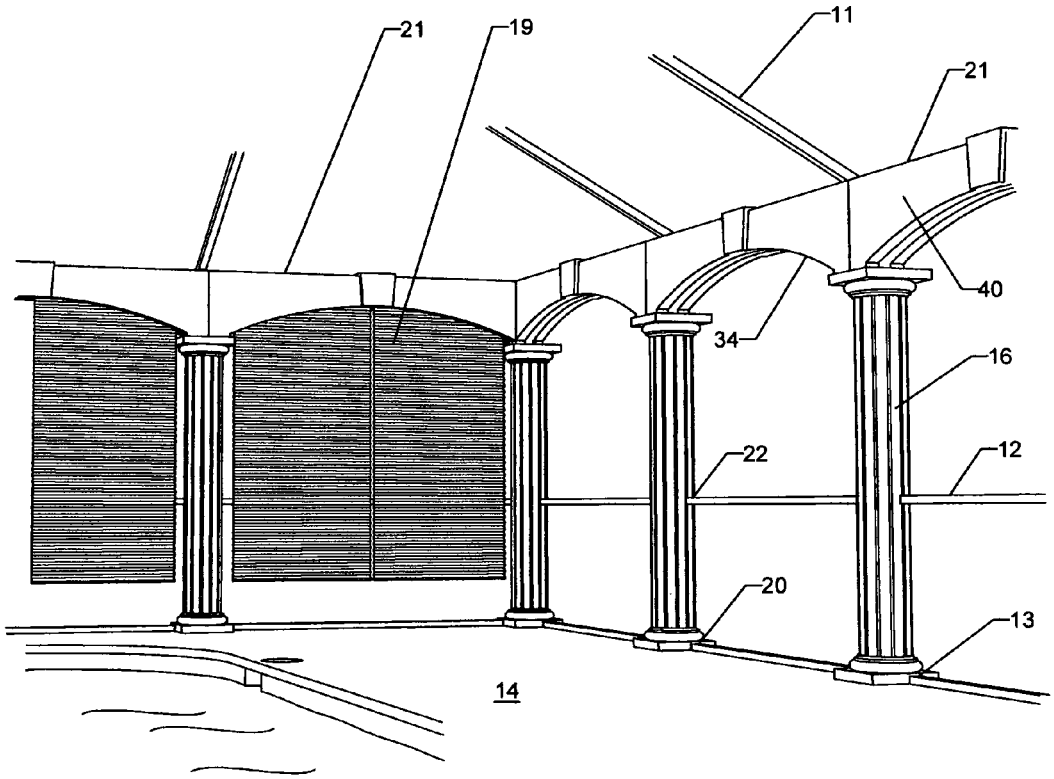
FIG. 2, is a perspective view of a pool cage showing an alternative design of the invention attached to a pool cage.
Figure 3:
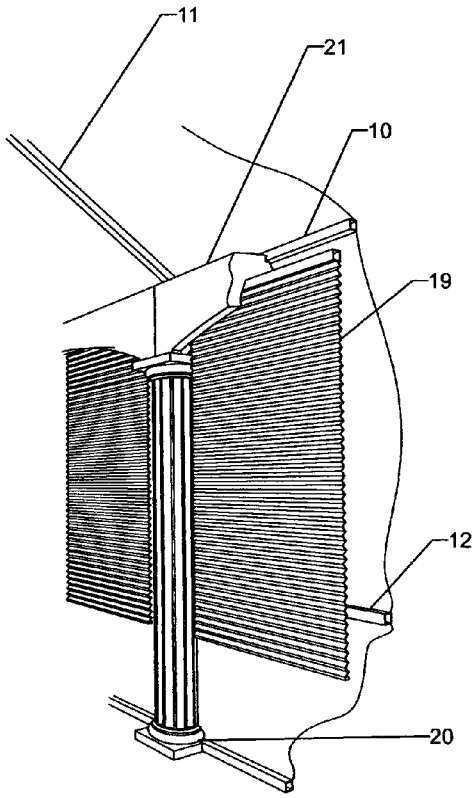
FIG. 3, is a sectional view showing the attachment of a shade fitted inside the foam cornice of the invention.
Figure 4:
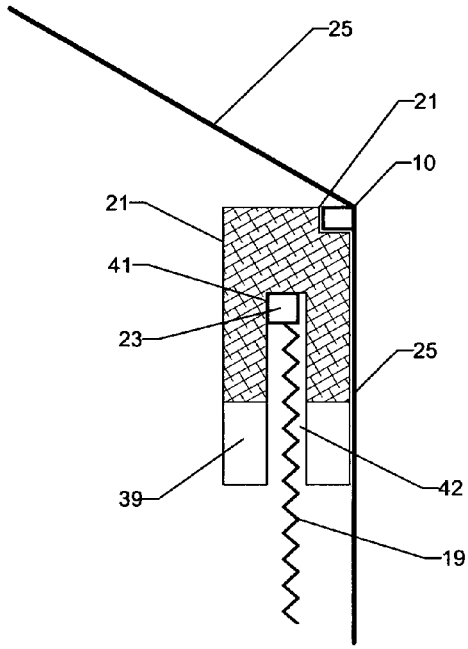
FIG. 4, is a detailed sectional view of the mounting of a shade fitted inside the foam cornice of the invention.
Figure 5:
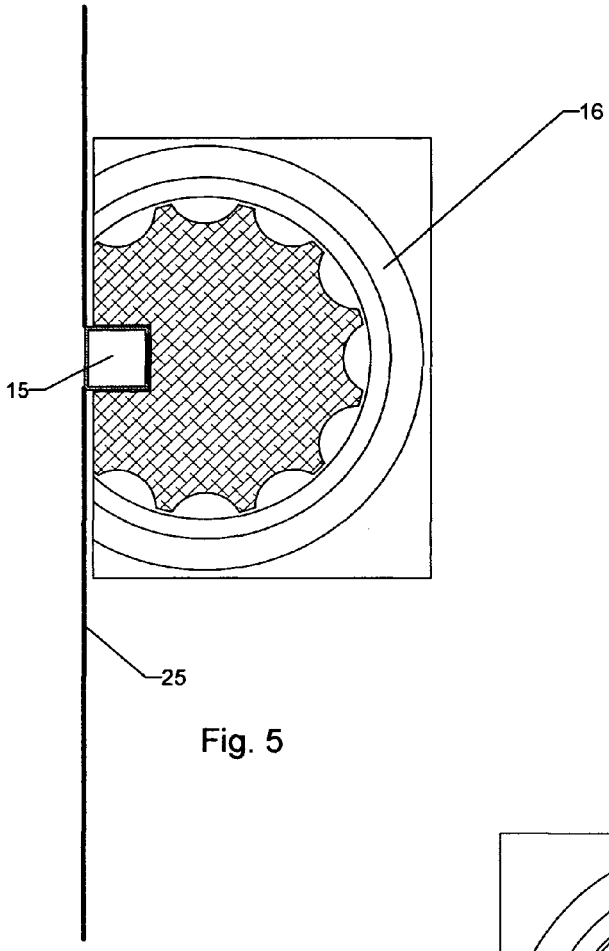
FIG. 5 is a top, sectional view of the attachment of a foam column to a vertical member of a pool cage.

In the first embodiment of the invention shown in FIGS. 1*a*-8, the foam cornices 17 are shown attached to the top cap tubing 10 (FIGS. 3 and 4). The foam columns 16 and 24 are shown mounted over the vertical tubing 15 (FIG. 5). Also attached to the foam cornices 17, are short lengths of decorative trim 18 to further decorate the inside of the pool cage 14. The decorative trim 18 may be made from STYROFOAM™ (polyethylene) and may be attached to cornice 17 by either magnet clips, adhesives, or hook and loop. In a preferred embodiment, the cornices 17 are attached to the top cap tubing 10 with adhesives.

FIGS. 3 and 4 are sectional views showing the attachment of a shade 19 fitted inside the foam cornice 21 and held in place with magnet clips or hook and loop 41. A shade or curtain 19 is shown suspended from the cornice 17 by magnet clip or VELCRO™ (hook and loop). The shade 19 may be attached to the top cap tubing 10 without the cornice 17 if the user would prefer. In either case, the shade 19 will be attached by magnet clip or hook and loop 41.

Foam trim 23, known in the trade as "the cookie" is placed either around the column 16 and the column 16 is set inside the trim 23 or it is made solid and the column 16 is placed on top of the trim 23. This allows for many different architectural designs. The trim 23 can be cut into any shape. The trim 23 is also cut so it can be placed over the aluminum frame 13. The columns 16 and 24 are cut as at 22 to fit over the horizontal aluminum cage frame 12 and will be attached by either magnets, adhesives, clips or VELCRO™ for easy removal so screens can be maintained. Foam columns 16 and 24 may be made in any shape, design, size or architectural design. The back side of the foam columns 16 and 24 are cut so that the columns may be placed over and attached to the frame 12. If it is desired to cover the outside of the cage 14, the column 16 may be cut in half and the back side of the frame 15 will have the other half of the column 16 attached. The columns 16 may be any size depth trims that are desired.

FIG. 2 is a perspective view of an alternative design of the invention attached to a pool cage 14. The magnets or clips, adhesives or VELCRO™ are placed in a depression, 21'(FIG. 4) at the top 21 of the foam cornice 40. The cornice 40 is then fastened to the existing aluminum cage tubing 10. The attachment of the foam cornice 40 along the entire length and width of the cage 14 provides decoration and additional strength to protect the cage 14 against high winds.

The foam cornice 40 may also be cut in the center from side to side to form a depression 41, deep enough for placement of the shade or curtain 19 and an arch 34 is formed to further decorate the cornice 40.

FIG. 5 is a top, sectional view of the attachment of a foam column 16 to a vertical member tubing 15 with a clip, magnet or VELCRO™ 41. The column 16 is attached to the inside of the pool cage 14 to hold the foam column to the cage 14 and be removable for cage 14 care, such as for example, to replace the screening or if hurricane winds are expected.

Figure 6:
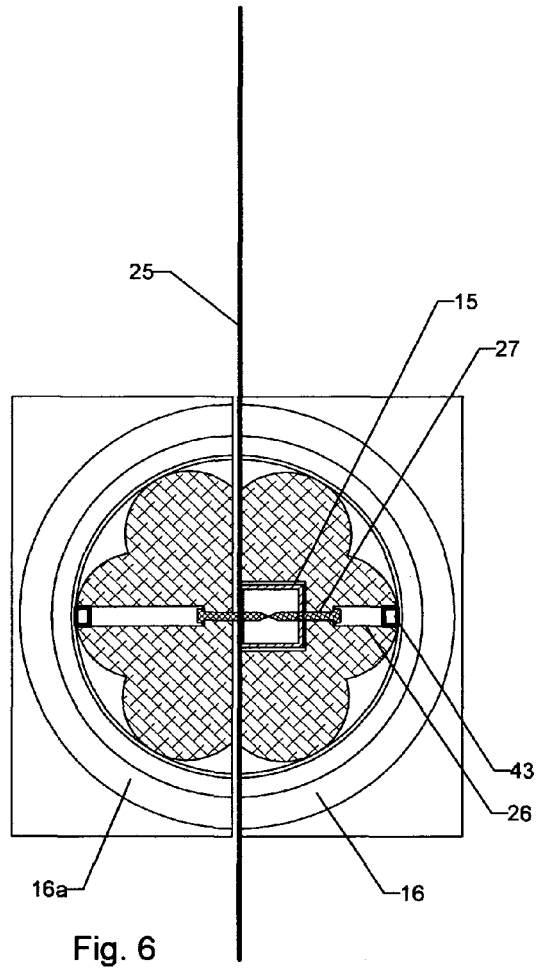
FIG. 6, is a top, sectional view of the attachment of a foam column to two sides of a vertical column of a pool cage.

FIG. 6 is a top, sectional view of the attachment of a foam column 16 and column 16*a* to two sides of a vertical column 15 of a pool cage 14. In this alternative embodiment, screws 27 are used to fasten the styrofoam columns 16 and 16*a* to the vertical column 15 of pool cage 14. The screws 27 may be magnets to hold the two columns 16 and 16*a* together.

Figure 7:
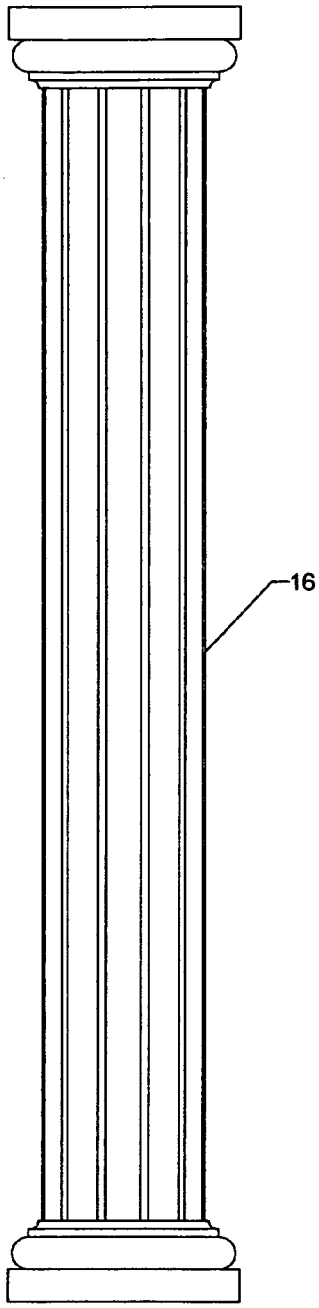
FIG. 7, is a side view of a first design of a foam column.
Figure 8:
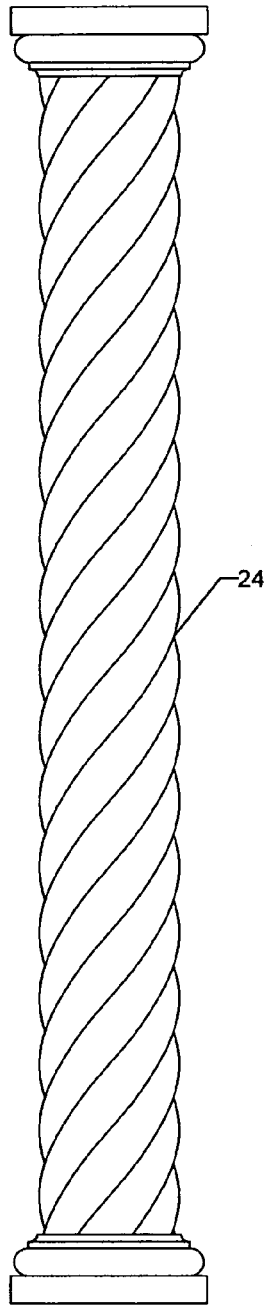
FIG. 8 is a side view of a second design of a foam column.

FIGS. 7 and 8 show two distinct styles of the foam column 16 and a second style of column 24. Since the foam is molded, the styles available to a designer are infinite.

Figure 9:
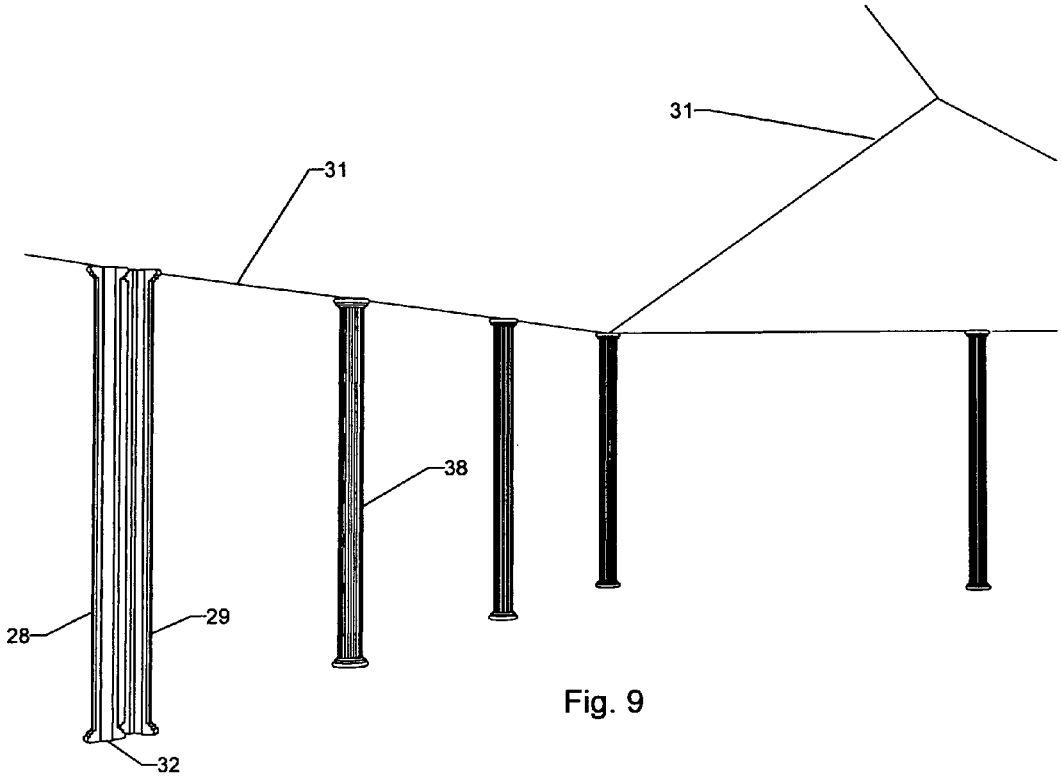
FIG. 9, is a perspective view of the foam column of the invention being attached to a tent pole.

FIG. 9 is a perspective view of the foam column 38 being attached to a series of tent poles. The two halves of the column 38, first half 28 and 29 are assembled on tent pole 32.

Figure 10:
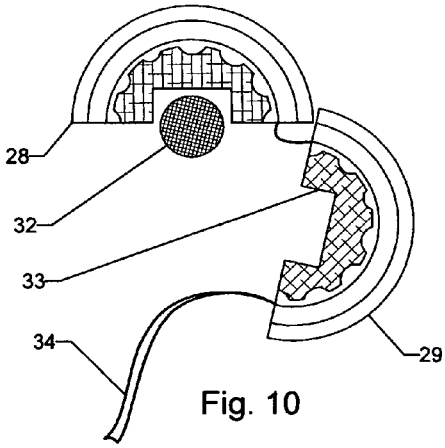
FIG. 10, is a top, sectional view of the foam column being strapped to a tent pole.

FIG. 10 is a top, sectional view of the two halves 28 and 29 being strapped to a tent pole 32 with a strap 34. The tent pole 32 fits into the void 33 formed in each of the halves 28 and 29.

Figure 11:
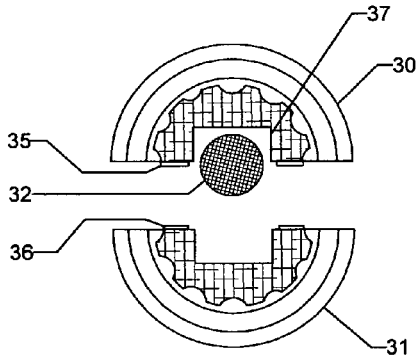
FIG. 11, is a top, sectional view of the foam column being attached to a tent pole with opposing magnets.

FIG. 11 is a top, sectional view of the two halves 30 and 31 being attached to each other with opposing magnets 35 and 36 attached at opposite ends of void 37 formed in halves 30 and 31.

The finished assembly, unlike all prior art pool enclosures, has no visible fastening members. The enclosure has the smooth appearance of a molded product, complete with a draw shade to provide privacy. Assembly is easy, due to the snap fittings between the sundry parts. The nature of the structure and the ease of casting foam parts to length enables contractors to build the enclosure quickly and hence economically.

To start the process of the invention, the designer and client decide on a style, and the screen enclosure or lanai is measured. After measuring the screen enclosure, the measurements are entered into AUTO CAD LT. After the auto Cad design is complete, the auto Cad is entered into adobe Photo shop to be rendered for the client's approval. The cad file is then entered into a computer controlled contour cutter, such as for example, the Horizontal Fast Wire Computer-Controlled Contour Cutter manufactured by "Demand Foam Cutting Systems", Alpharetta, Ga.

A preferred embodiment of the instant invention is made from a two pound foam for all of the materials to produce a superior quality product for the colonnades. A typical foam is produced by "Future Form", Bradenton, Fla. and has typical physical properties such as thermal resistance, strength properties, and moisture resistance.

Shapes to create the colonnade are cut by the contour cutter and then taken to the site for a custom fit. Once the pieces for the colonnade are custom fit to the cage, they are returned to the shop for coating. The coating process is done with a "Poly-Spray™ Polyurea System". The automatic gun is the newest, state-of-the-art dispensing gun. An eps/puf foam "hardcoat" is applied from the poly sprayer onto the two pound foam. This application assures protection to the foam and provides strength and durability. The process used includes:

Materials
Step 1. EPS/PUF foam
Step 2. STYROTHANE™ Series (Hard Coat)
Step 3. OPTIONAL FINISHES
A) Architectural Coating
B) Scenic Paint The spray applied, instant cure STYROTHANE™ produces a hard, protective shell which seals the foam while preserving the slightest details and contours of the piece.

After the primer is applied, a texture coat is then applied. A preferred coating is an "Aggregate Textured, 100% Acrylic-Based DPR "Dirt Pickup Resistant" Finish". A source for the DPR is Dryvit Systems, Inc., West Warwick, R.I.

Colonnade pieces are then painted and sent to the client's pool cage or lanai for final installation. ACRI-SHIELD™ sold by Porter Paints, Louisville, Ky. The paint gives a mildew resistant coating and resists dirt pickup.

A construction adhesive is used to attach the colonnade to the existing screen enclosure or lanai. A preferred adhesive is HANDI-STICK™ Construction Adhesive manufactured by Fomo Products, Inc., Norton Ohio. The adhesive is a unique polyurethane based foam, which also is an effective hole filler and insulating sealant.

The finished assembly, unlike all prior art pool enclosures, has no visible fastening members. The enclosure has the smooth appearance of a molded product, complete with a draw down shade to provide privacy. Assembly is easy, due to the snap fittings or adhesive between the sundry parts. The modular nature of the structure and the ease of casting foam parts to length enables contractors to build the enclosure quickly and hence economically.

The striking beauty of the novel enclosure greatly enhances the value of the house to which it is connected.

It will be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpretive as illustrative and not in a limiting sense.

It is also to be intended that the following claims are intended to cover all of the generic and specific features of the invention herein described, and all statements of the scope of the invention which, as a matter of language, might be said to fall therebetween.

What is claimed is:

1. A combination of an enclosure and a treated foam design attached to said enclosure for beautification and enforcement of said enclosure, said combination comprising:

a screened enclosure having a plurality of vertical aluminum tubing sections, a plurality of horizontal aluminum tubing sections, a plurality of base aluminum tubing sections, a plurality of top cap aluminum tubing sections, and a plurality of roof tubing sections, each of said tubing sections being assembled over a swimming pool lanai thereby forming an insect repelling enclosure, a plurality of aesthetically formed foam vertical columns, horizontal cornices and trim, a depression being formed along a top corner edge of each of said cornices for attaching to said top cap aluminum tubing sections, a depression being formed along a vertical center of each of said vertical columns for attaching to said vertical aluminum tubing sections and a horizontal cut in said vertical columns for attaching to said horizontal tubing sections, each of said plurality of columns, cornices, and trim being assembled, mounted on, and fastened to, a corresponding vertical or horizontal aluminum section by mating and gluing.

2. A combination of an enclosure and a treated foam design attached to said enclosure of claim 1 wherein said foam cornice is formed having a depression in the center from side to side and a shade/curtain being mounted in said depression and being held in position in said cornice with fastening means selected from the group including hook and loop, clips and magnets.

* * * * *